US008021290B2

(12) United States Patent
Patel et al.

(10) Patent No.: US 8,021,290 B2
(45) Date of Patent: Sep. 20, 2011

(54) OIL CENTRIFUGE FOR EXTRACTING PARTICULATES FROM A FLUID USING CENTRIFUGAL FORCE

(75) Inventors: Vipul P. Patel, Irvine, CA (US); Allen K. MacKnight, Signal Hill, CA (US); Steven R. Eccles, Torrance, CA (US); Leonard Walitt, Marina Del Rey, CA (US)

(73) Assignee: Honeywell International Inc., Morristown, NJ (US)

( * ) Notice: Subject to any disclaimer, the term of this patent is extended or adjusted under 35 U.S.C. 154(b) by 967 days.

(21) Appl. No.: 11/945,156

(22) Filed: Nov. 26, 2007

(65) Prior Publication Data

US 2009/0137376 A1 May 28, 2009

(51) Int. Cl.
*B04B 11/06* (2006.01)

(52) U.S. Cl. ..... 494/67; 494/49

(58) Field of Classification Search ..... 494/24, 494/36, 43, 49, 64, 65, 67, 83, 84, 901, 5, 494/60, 31–34; 210/171, 232, 360.1, 380.1, 210/416.5; 184/6.24
See application file for complete search history.

(56) References Cited

U.S. PATENT DOCUMENTS

| | | | | | |
|---|---|---|---|---|---|
| 2,650,022 | A | * | 8/1953 | Fulton et al. | 494/49 |
| 3,432,091 | A | * | 3/1969 | Beazley | 494/36 |
| 3,784,092 | A | * | 1/1974 | Gibson | 494/2 |
| 3,879,294 | A | * | 4/1975 | Ellis et al. | 210/354 |
| 4,221,323 | A | * | 9/1980 | Courtot | 494/10 |
| 4,230,581 | A | * | 10/1980 | Beazley | 210/261 |
| 5,779,618 | A | | 7/1998 | Onodera et al. | |
| 6,017,300 | A | | 1/2000 | Herman | |
| 6,156,193 | A | | 12/2000 | Meinhold et al. | |
| 6,183,407 | B1 | * | 2/2001 | Hallgren et al. | 494/49 |
| 6,200,252 | B1 | * | 3/2001 | Hallgren et al. | 494/49 |
| 6,210,311 | B1 | | 4/2001 | May | |
| 6,213,928 | B1 | * | 4/2001 | Joshi et al. | 494/10 |
| 6,224,531 | B1 | * | 5/2001 | Frehland et al. | 494/49 |
| 6,234,949 | B1 | * | 5/2001 | Cox et al. | 494/49 |
| 6,238,331 | B1 | * | 5/2001 | Cox et al. | 494/49 |
| 6,424,067 | B1 | * | 7/2002 | Samways | 310/90.5 |
| 6,457,868 | B1 | * | 10/2002 | Fischer et al. | 384/192 |
| RE38,855 | E | * | 10/2005 | Cox et al. | 494/49 |
| 6,974,408 | B2 | | 12/2005 | Grousse-Wiesmann | |
| 6,984,200 | B2 | * | 1/2006 | Samways | 494/49 |
| 7,959,546 | B2 | * | 6/2011 | Patel et al. | 494/49 |
| 2004/0152578 | A1 | * | 8/2004 | Samways | 494/49 |
| 2004/0226437 | A1 | | 11/2004 | Stenersen et al. | |
| 2008/0173592 | A1 | * | 7/2008 | Patel et al. | 210/787 |
| 2009/0137376 | A1 | * | 5/2009 | Patel et al. | 494/37 |

FOREIGN PATENT DOCUMENTS

| | | | | |
|---|---|---|---|---|
| GB | 1356696 | A | * | 6/1974 |
| GB | 2322315 | A | * | 8/1998 |
| RU | 2033860 | C1 | * | 4/1995 |

* cited by examiner

*Primary Examiner* — Charles E Cooley
(74) *Attorney, Agent, or Firm* — Robert Desmond, Esq.

(57) ABSTRACT

A centrifuge is employed to continuously remove particulates from a fluid. In one embodiment, the centrifuge removes small particles of soot from lubricating oil of diesel engines. The fluid is introduced into the centrifuge through a distribution rotor so that vortexes are not propagated in the fluid. Laminar flow of the fluid down the sides of the outer rotor may contribute to the soot-removal effectiveness of the centrifuge.

13 Claims, 5 Drawing Sheets

OIL CENTRIFUGE FOR EXTRACTING PARTICULATES FROM A FLUID USING CENTRIFUGAL FORCE

BACKGROUND OF THE INVENTION

The present invention generally relates to centrifuges and, more particularly, to centrifuges employed to remove particulates from lubricants.

Centrifuges have often been employed to remove various particulate contaminants from lubricating oil of internal combustion engines. The most common applications of centrifuges in this context have been in large diesel engines. Typically, lubricating oil of a large diesel engine may be continuously passed through a full flow filter and through a bypass centrifugal filter or centrifuge. While conventional centrifugal filters may be relatively costly, their cost is justified because engine life is improved when they are used.

Recent developments in environmental standards have introduced additional demands on filtering systems for diesel engine oil. Injector timing retardation is needed to meet more stringent air pollution standards. These demands result in increased production of carbon soot on the cylinder walls of an engine. Soot finds its way into the lubricating oil of the engine. Conventional full flow filters and conventional centrifugal filters do not adequately remove soot from the oil. Engine life is reduced in the presence of soot in the oil because the soot is abrasive and it reduces lubricating qualities of the oil.

Various efforts have been made to improve performance of centrifuges in attempts to introduce soot removal capabilities. Some examples of these efforts are illustrated in U.S. Pat. No. 6,019,717, issued Feb. 1, 2000 to P. K. Herman and U.S. Pat. No. 6,984,200 issued Jan. 10, 2006 to A. L. Samways. Each of these designs is directed to a problem of removing very small particles of soot, i.e., particles of about 1 to about 2 microns. Centrifuges separate particulates from fluids by exposing the particulates to centrifugal forces. Particulates with a density greater than the fluid are propelled radially outwardly through the fluid. But, in the case of soot particles suspended in oil, separation is difficult because soot particles have a density very close to oil. Consequently, very high centrifugal forces may be required to move the soot particles through oil. Typically centrifugal forces of about 10,000 g's may be needed. These high forces may be produced by rotating a centrifuge at very high speeds. Alternatively, the requisite high g forces may be produced within a centrifuge having a very large diameter. However, as a practical matter, it is desirable to limit the diameter of a centrifuge to diameter of about 7 to 10 inches to meet space limitation on a vehicle and to limit rotational inertial effects. Also there is a practical limitation on the rotational speed that can be imparted to a centrifuge. Speeds of about 10,000 to about 12,000 rpm represent the limits of the current state of the art.

In attempts to capture small soot particles within these practical speed and size parameters, prior art centrifuges employ complex and labyrinth-like oil passage pathways. As oil traverses these complex pathways, it remains in a centrifuge for a relatively long time. In other words, it has an extended "residence time". It has heretofore been assumed that improved soot removal is directly related to increased residence time.

But, in various efforts to increase residence time, prior art centrifuges have employed oil passage pathways that introduce multiple changes in direction of flow of oil. Many of these changes in flow direction may be abrupt. As oil flow makes these abrupt changes in direction, vortices may be generated. These vortices may propagate throughout the entire mass of oil that may be present in a prior art centrifuge, resulting in oil flow that is turbulent in nature. Turbulence in oil flow may produce additional difficulty in removing small particles from the oil. Whenever any one particle is propelled outwardly by centrifugal force in a turbulent flow, there is a high probability that the particle will encounter a reverse flow of oil in a vortex. Such a reverse flow may propel the particle inwardly and thus cancel the desired effects of centrifugal force imparted by the centrifuge. Thus, the particle has a high probability of remaining suspended in the oil.

It can be seen that soot removal effectiveness of centrifuges in the present state of the art is bounded by various limiting conditions. First, there is a practical limit on a diameter of a centrifuge. Second, there is a practical limit on the rotational speed at which a centrifuge may be operated. And third, increased residence times may be attained at the cost of producing turbulent flow in a centrifuge. As described above, turbulent flow may offset or cancel any beneficial effects of increasing residence time. There has been no recognition in the prior art of a simple expedient to increase the soot removal effectiveness of centrifuges within the practical limits of centrifuge size and rotational speed.

As can be seen, there is a need for improvement of soot removal effectiveness in a practical centrifuge.

SUMMARY OF THE INVENTION

In one aspect of the present invention, an apparatus for extracting particulates from a fluid comprises a distribution rotor rotating with rotation of a spindle; a spindle passageway, inside the spindle, delivering the fluid to the distribution rotor; an outer rotor, rotating with rotation of the spindle, receiving the fluid expelled from the distribution rotor through centrifugal force, wherein the centrifugal force holds at least a portion of the particulates in the fluid to the outer rotor while the fluid may flow down an interior surface of the outer rotor.

In another aspect of the present invention, a centrifuge for extracting particulates from a fluid comprises a spindle, having a spindle passageway therewithin; a distribution rotor having distribution rotor channels, the distribution rotor channels fluidly communicating with the spindle passageway; and an outer rotor receiving fluid expelled from the distribution rotor channels through centrifugal force during rotation of the spindle, distribution rotor and outer rotor, wherein the centrifugal force holds at least a portion of the particulates in the fluid to the outer rotor while the fluid may flow down an interior surface of the outer rotor, and the portion of the particulates held to the outer rotor includes particulates having a size less than about 2 microns.

In still another aspect of the present invention, a method for removing particulates from a fluid comprises producing a flow of the fluid down an outer rotor of a centrifuge; and imparting centrifugal force on the fluid in a direction orthogonal to a direction of the flow of the fluid to capture the particulates from the fluid.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention may be useful in improving effectiveness of particulate removal of a centrifuge. More particularly, the present invention may provide a simple expedient to improve soot removal effectiveness that can be applied to a centrifuge that is operated and constructed within the bounds of practical size and speed of conventional centrifuges.

In contrast to prior art centrifuges, among other things, the present invention may provide a centrifuge that operates with a fluid flow therethrough which is laminar, i.e. non-turbulent. A desirable improvement of soot-removal effectiveness may achieved by constructing a centrifuge in an inventive configuration illustrated in FIG. 1.

Figure 1:
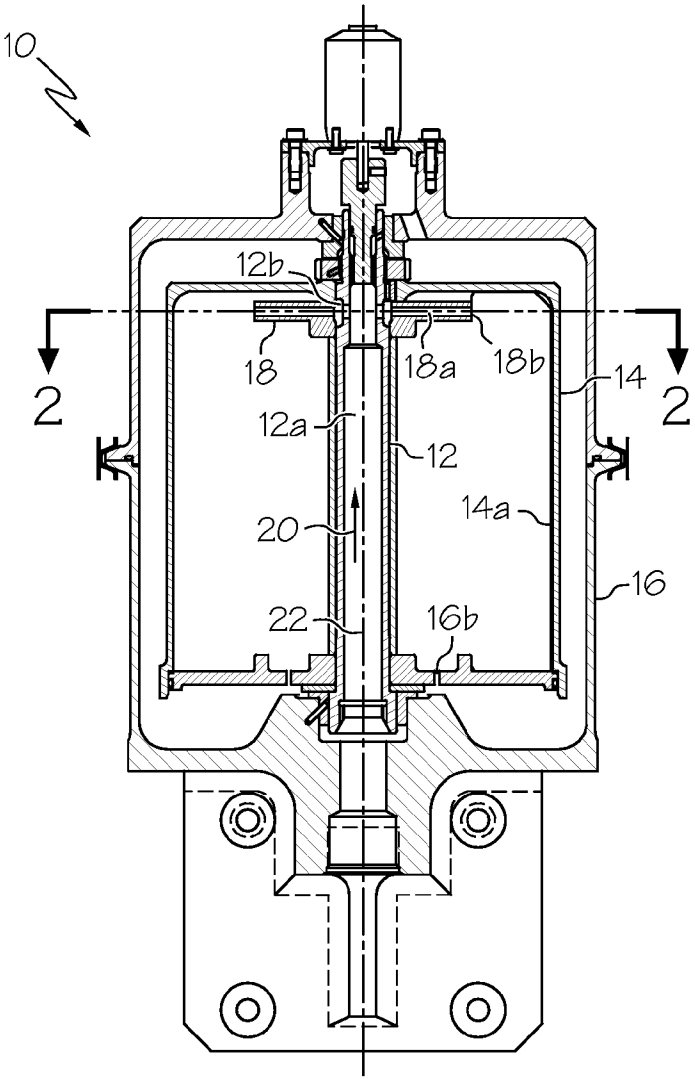
FIG. 1 is a cross sectional view of a centrifuge constructed in accordance with one embodiment of the present invention.

Referring now to FIG. 1, there is shown a sectional view of a centrifuge 10. The centrifuge 10 may be comprised of a spindle 12, an outer rotor 14, a housing 16, a distribution rotor 18 and a driving device, such as a turbine (not shown). The driving device may rotate the spindle 12, the outer rotor 14 and the distribution rotor 18 inside of the housing 16. The driving device may rotate these components at a velocity of from about 5,000 revolutions per minute (rpm) to about 15,000 rpm, typically about 10,000 rpm.

A fluid (as indicated by an arrow 20) such as lubricating oil may be introduced under pressure into the spindle 12. The fluid 20 may flow through a spindle passageway 12*a* and may exit the spindle passageway 12*a* at spindle exit ports 12*b*. The fluid 20 may then continue into the distribution rotor 18 and proceed through distribution port channels 18*a* to distribution rotor exit ports 18*b*. From here, the fluid may be expelled from the exit ports 18*b* to impinge upon the outer rotor 14. The fluid may move down an inside 14*a* of the outer rotor 14, through the force of gravity and/or pressure, with a substantially laminar flow. The fluid 20 may then proceed into the housing 16 through a return drain 16*b*. As the fluid 20 flows through the centrifuge 10, the fluid 20 may be subjected to centrifugal forces generated by rotation of the rotor 14 about a centrifuge axis 22. The centrifugal forces are applied to the fluid 20 in a direction that is orthogonal to the axis 22.

Figure 2:
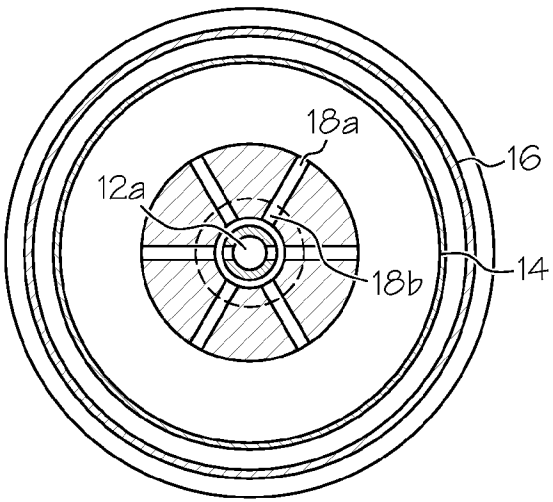
FIG. 2 is a cross sectional view of a portion of the centrifuge of FIG. 1 taken along the line 2-2 showing various features in accordance with the present invention.

Referring to FIG. 2, there is shown cross sectional view of a portion of the centrifuge 10 of FIG. 1 taken along the line 2-2. In this view, the distribution rotor 18 has six distribution port channels 18*a* through which the fluid 20 may exit the spindle passageway 12*a*. This configuration for the distribution rotor 18 is shown for example and is not meant to limit the scope of the present invention. Any number of distribution port channels 18*a* may be present to communicate fluid 20 from the spindle passageway 12*a* to the outer rotor 14.

Figure 3:
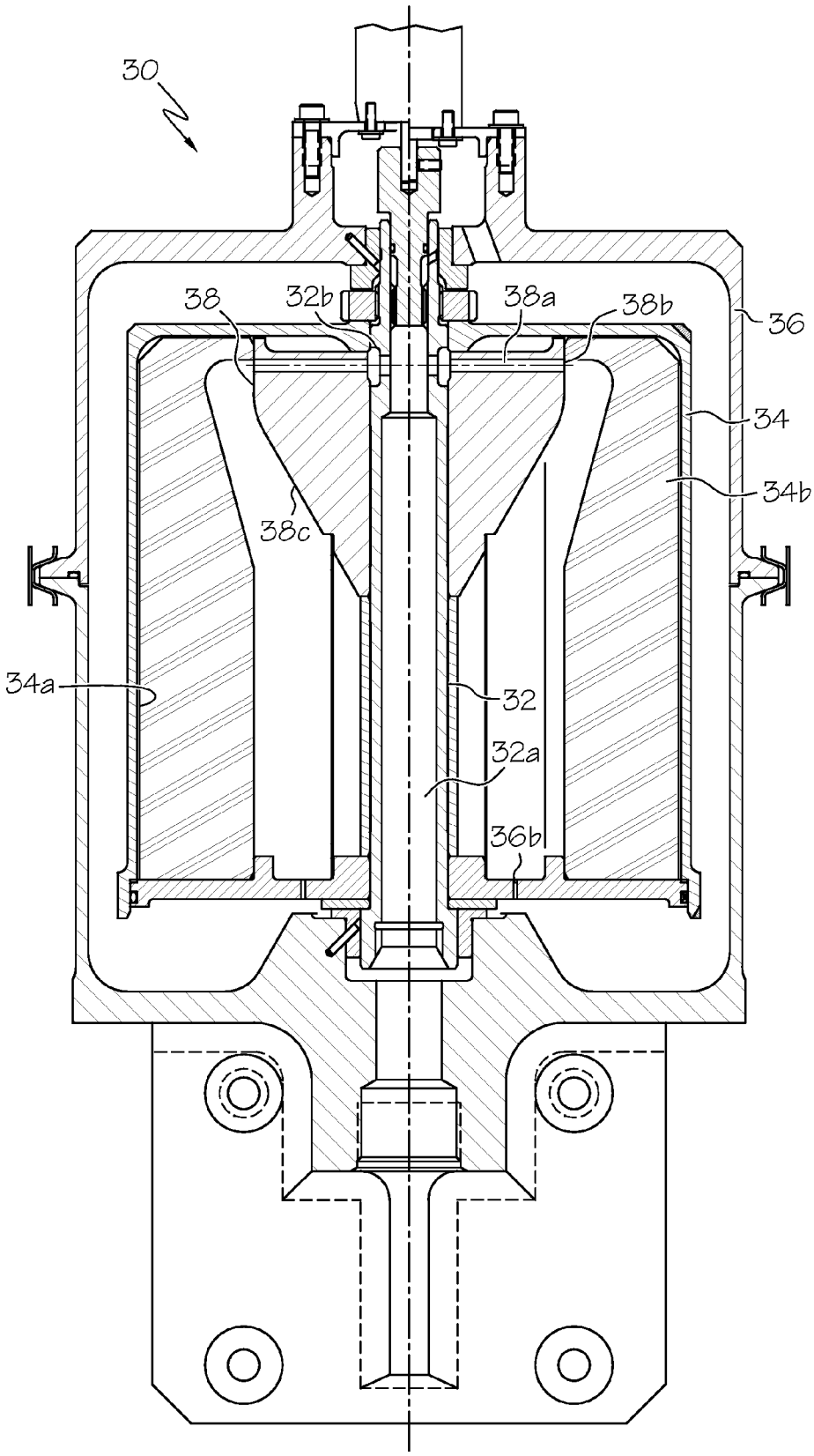
FIG. 3 is a cross sectional view of a centrifuge constructed in accordance with one embodiment of the present invention.

Referring now to FIG. 3, there is a cross sectional view of a centrifuge 30 constructed in accordance with one embodiment of the present invention. Similar to the centrifuge 10 of FIG. 1, the centrifuge 30 may comprise a spindle 32, an outer rotor 34, a housing 36, a distribution rotor 38 and a driving device, such as a turbine (not shown). The driving device may rotate the spindle 32, the outer rotor 34 and the distribution rotor 38 inside of the housing 36.

The fluid (as indicated by arrow 20) such as lubricating oil may be introduced under pressure into the spindle 32. The fluid 20 may flow through a spindle passageway 32*a* and may exit the spindle passageway 32*a* at spindle exit ports 32*b*. The fluid 20 may then continue into the distribution rotor 38 and proceed through distribution port channels 38*a* to distribution rotor exit ports 38*b*. From there, the fluid 20 may be expelled from the exit ports 38*b* to impinge upon the outer rotor 34. The fluid may move down an inside 34*a* of the outer rotor 34, through the force of gravity and/or pressure, with a substantially laminar flow. The distribution rotor 38 may have a conical inner structure 38*c* to guide the flow of the fluid 20. The conical inner structure may have a larger diameter near distribution channels 38*a* in the distribution rotor 38 and a smaller diameter away from the distribution channels 38*a*. The fluid 20 may then proceed into the housing 16 through a return drain 36*b*. As the fluid 20 flows through the centrifuge 30, the fluid 20 may be subjected to centrifugal forces generated by rotation of the rotor 34 about the centrifuge axis 22. The centrifugal forces are applied to the fluid 20 in a direction that is orthogonal to the axis 22. The embodiment of FIG. 3 shows one example of soot collection in a cross-hatched portion 34*b* of the outer rotor 34.

Figure 4:
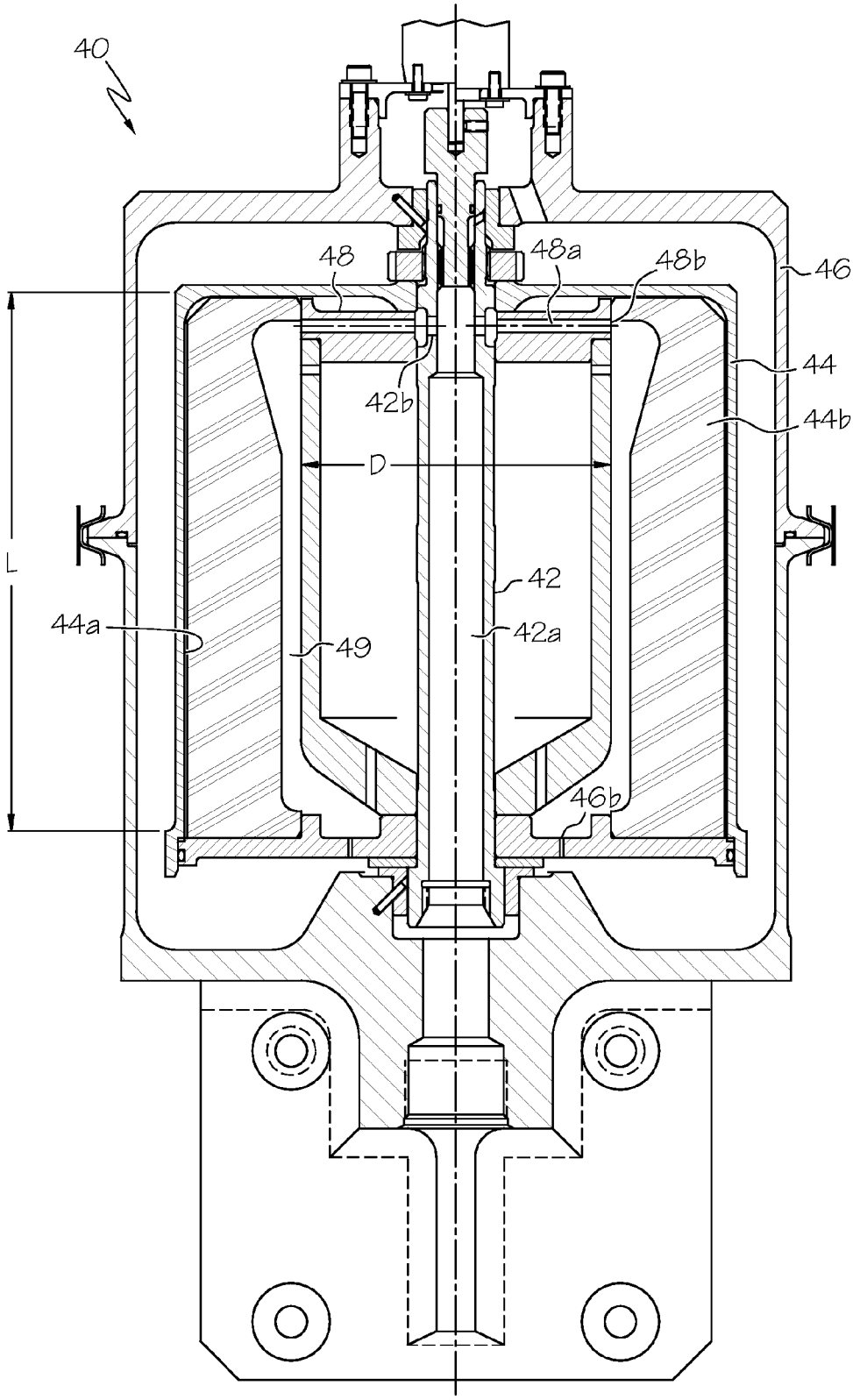
FIG. 4 is a cross sectional view of a centrifuge constructed in accordance with one embodiment of the present invention.

Referring now to FIG. 4, there is a cross sectional view of a centrifuge 40 constructed in accordance with one embodiment of the present invention. Similar to the centrifuge 10 of FIG. 1, the centrifuge 40 may comprise a spindle 42, an outer rotor 44, a housing 46, a distribution rotor 48 and a driving device, such as a turbine (not shown). The driving device may rotate the spindle 42, the outer rotor 44 and the distribution rotor 48 inside of the housing 46.

The fluid (as indicated by arrow 20), such as lubricating oil, may be introduced under pressure into the spindle 42. The fluid 20 may flow through a spindle passageway 42*a* and may exit the spindle passageway 42*a* at spindle exit ports 42*b*. The fluid 20 may then continue into the distribution rotor 48 and proceed through distribution port channels 48*a* to distribution rotor exit ports 48*b*. From there, the fluid 20 may be expelled from the exit ports 48*b* to impinge upon the outer rotor 44. The fluid may move down an inside 44*a* of the outer rotor 44, through the force of gravity and/or pressure, with a substantially laminar flow. The distribution rotor 48 may have a diameter D that is substantially constant along length L of the outer rotor 44. This structure may result in an annular oil flow passage 49 that has a substantially constant width W throughout the flow passage 49.

The fluid 20 may then proceed into the housing 46 through a return drain 46*b*. As the fluid 20 flows through the centrifuge 40, the fluid 20 may be subjected to centrifugal forces generated by rotation of the rotor 44 about the centrifuge axis 22. The centrifugal forces are applied to the fluid 20 in a direction that is orthogonal to the axis 22. The embodiment of FIG. 4 shows one example of soot collection in a cross-hatched portion 44*b* of the outer rotor 44.

Example

Figure 5:
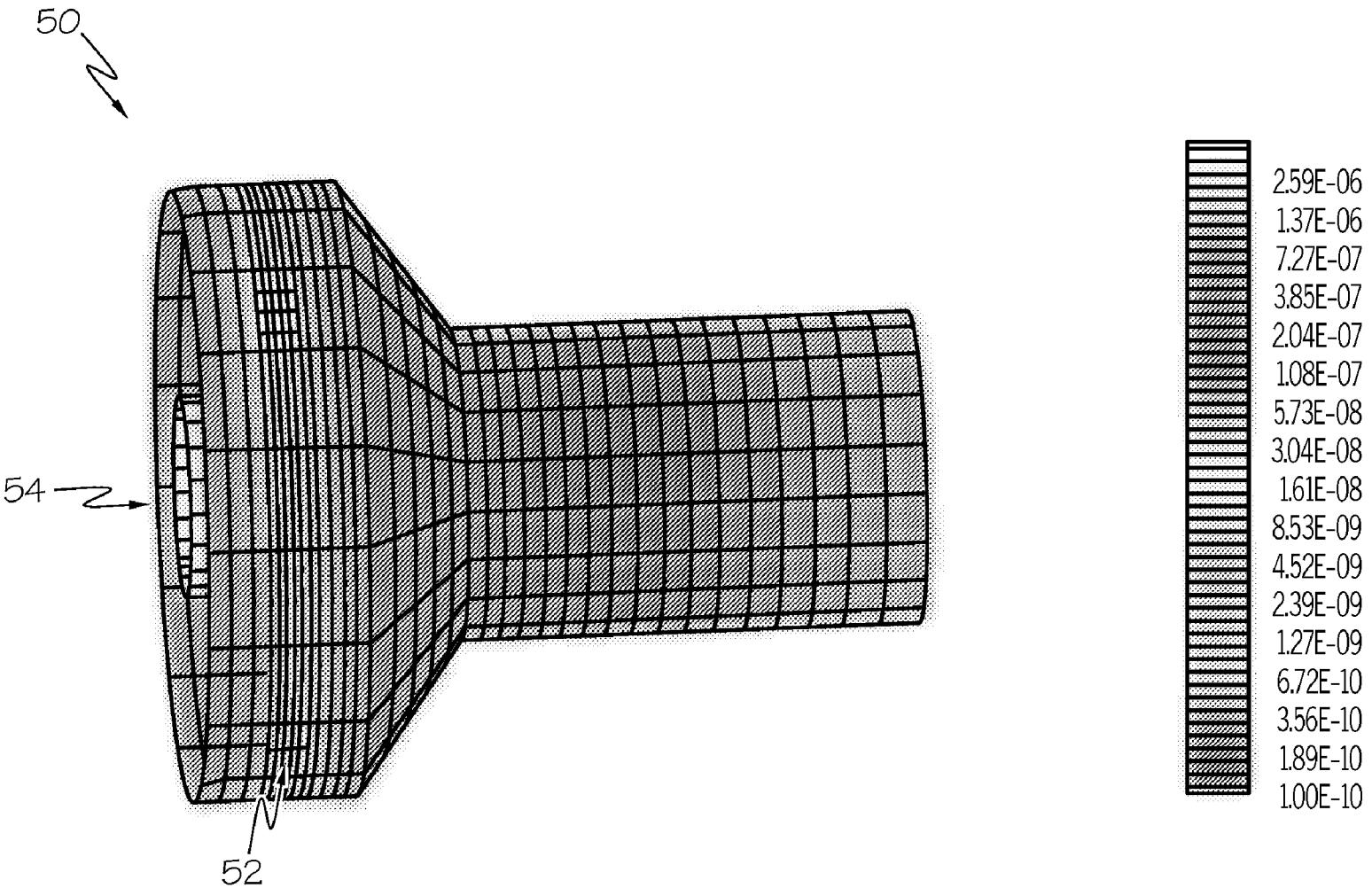
FIG. 5 is a computer image of the distribution rotor according to the embodiment of FIG. 3.

Referring to FIG. 5, there is shown a computer image of a distribution rotor 50 similar to the design of FIG. 3. The distribution rotor 50 was designed through a fluid dynamics computer simulation to determine the effectiveness of the centrifuge of the present invention. The distribution rotor 50 had four distribution channels 52 formed therein to allow fluid to move from a spindle passageway 54 to an outer rotor (not shown). The scale in FIG. 5 shows the density of soot particles that may be collected in the outer rotor after 1852.11 ms of operation of the centrifuge of the present invention.

In this example, oil containing soot was flowed through the centrifuge at about 2 gallons per minute at a pressure of 50 psi and a temperature of 100° C. The distribution rotor 50 was rotated at an angular velocity of 10,000 rpm. The soot particle size varied from about 0.0666 microns to about 0.1971 microns.

This example shows that the centrifuge of the present invention is useful for soot removal, even soot particles that are relatively small (<2 microns). In this context, engine wear from soot may be substantially reduced, as compared with the prior art. Soot particles larger than about 2 micrometers (μm) may be removed from lubrication systems with more conventional filtration devices. But conventional filtration systems typically may not control small particle soot accumulation at an equilibrium concentration. In prior art engines, small particle-soot removal lags behind soot production. There is a gradual buildup of small-particle soot until it becomes necessary to replace the lubricating oil with new oil that is free of soot. Typically, replacement is needed when soot concentration exceeds 1-2%.

The centrifuge of the present invention may extract small-particle soot at virtually the same rate that it is produced by the engine until an equilibrium concentration of about 1% or less is reached. After that point in time, the centrifuge of the present invention may control small-particle soot concentration at about 1% or less for an indefinite time.

Figure 6:
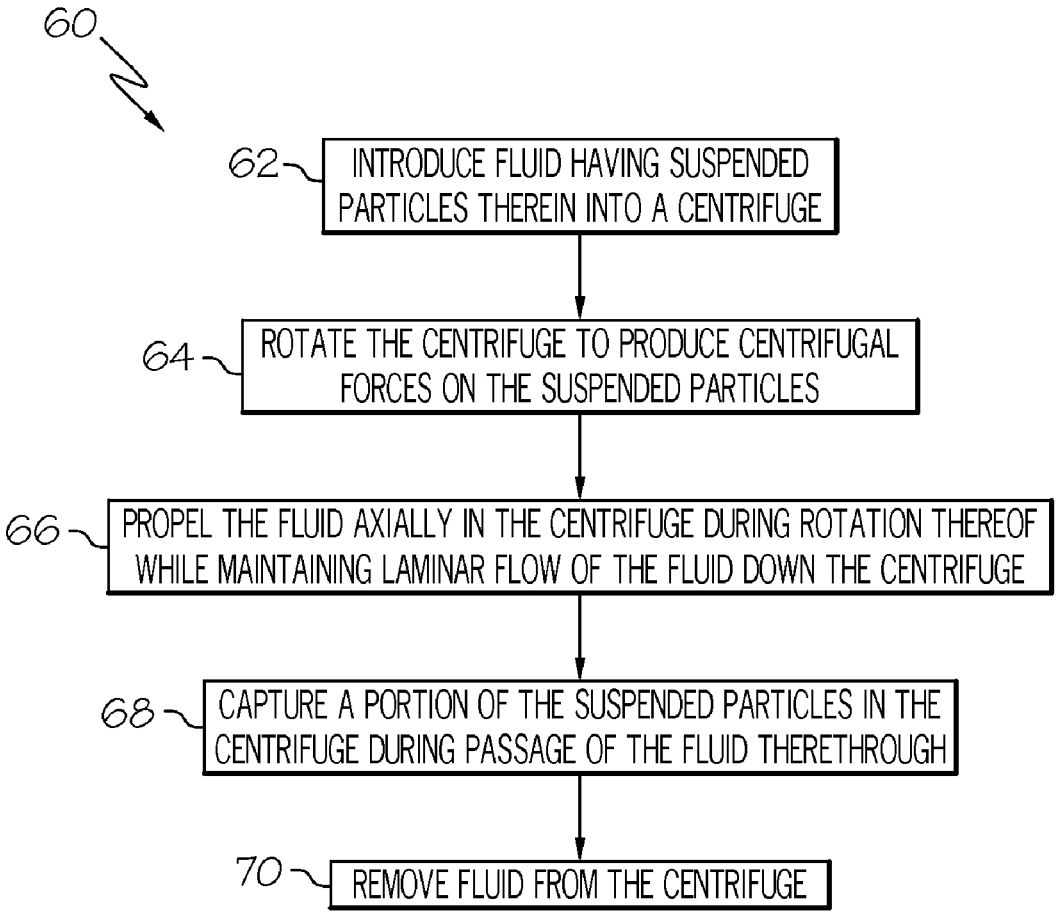
FIG. 6 is a flow chart of a method of collecting particulates from a fluid in accordance with the present invention.

The present invention may be considered a method for removing particulates from the fluid 20. In that regard the method may be understood by referring to FIG. 6. In FIG. 6, a schematic diagram portrays various aspects of an inventive method 60. In a step 62, the fluid (e.g., fluid 20) with suspended particles therein may be continuously introduced into the centrifuge (e.g., centrifuge 10) as a laminar flow. In a step 64, the fluid may be rotated to produce centrifugal forces on the suspended particles. In a step 66, the fluid 20 may be continuously propelled axially in the centrifuge during rotation thereof. Laminar flow of the fluid may be maintained during the axial propelling of the fluid. In a step 68, a portion of the suspended particles may be captured during passage of the fluid through the centrifuge. In a step 70 the fluid may be continuously removed from the centrifuge 10 in an amount that corresponds to an amount introduced in step 62.

During performance of the method 60 it may be desirable to maintain a flow of the fluid so that a Reynolds number (Re) associated with the flow is about 1000 or less. A Reynolds Number less than 1000 is typically definitive of laminar, i.e., non-turbulent flow. For any particular fluid flow Re is a function of various parameters in accordance with the following expression:

$$Re=\rho VDe/\mu$$

where

μ=Absolute Viscosity of a fluid

ρ=Density of a fluid

V=Velocity of flow

De=Equivalent Hydraulic Diameter.

Additionally, it may be desirable to perform the rotating step 64 so that centrifugal forces equivalent to a centrifugal acceleration of about 10,000 g's are applied to the particles.

The method 60 may be particularly useful for capturing small particles of soot that are suspended in lubricating oil of an engine. In that context, the method 60 may be advantageously performed by conducting the rotating step 304 at about 10,000 to about 12,000 rpm. Additionally, the method may be advantageously conducted by performing the capture step 68 at a radius of about 3 to about 5 inches from an axis of rotation of the centrifuge. When employed in this context, the method 60 may provide for an equilibrium concentration of about 1% or less of soot particles less than about 2 μm in an engine lubricating system with a capacity of about 40 liters.

It should be understood, of course, that the foregoing relates to exemplary embodiments of the invention and that modifications may be made without departing from the spirit and scope of the invention as set forth in the following claims.

We claim:

1. An apparatus for extracting particulates from a fluid, comprising:

a distribution rotor configured to rotate with rotation of a spindle;

a spindle passageway, inside the spindle, disposed for delivering the fluid to the distribution rotor;

a plurality of distribution rotor channels in the distribution rotor positioned on the upper end of the spindle, the distribution rotor channels disposed to communicate the fluid from the spindle passageway inside the spindle and expel the fluid orthogonally from ends of the rotor channels to the outer rotor; and an outer rotor, disposed for receiving the fluid expelled from the distribution rotor through centrifugal force, and configured to rotate with rotation of the spindle such that during operation of the apparatus the centrifugal force holds at least a portion of the particulates in the fluid to the outer rotor while the fluid may flow down an interior surface of the outer rotor.

2. The apparatus according to claim 1, further comprising holes in a bottom portion of the outer rotor.

3. The apparatus according to claim 1, further comprising a housing containing the outer rotor, spindle and distribution rotor, the housing is disposed such that the housing remains stationary during operation of the apparatus.

4. The apparatus according to claim 1, wherein the fluid is oil and the particulates are soot particles.

5. The apparatus according to claim 4, wherein the soot particles include soot particles less than 2 microns, and wherein the soot particles less than 2 microns are held to the outer rotor during operation of the apparatus.

6. The apparatus according to claim 1, wherein the distribution rotor has a conical inner structure.

7. The apparatus according to claim 6, wherein the conical inner structure has a larger diameter near distribution channels in the distribution rotor and a smaller diameter away from the distribution channels.

8. The apparatus according to claim 1, wherein the distribution rotor has a diameter that is substantially constant along a length of the outer rotor.

9. The apparatus according to claim 1, wherein the outer rotor is removable for cleaning or replacement.

10. A centrifuge for extracting particulates from a fluid, comprising:

a spindle, having a spindle passageway therewithin;

a distribution rotor coupled to the spindle and having distribution rotor channels projecting orthogonally from the spindle, the distribution rotor channels including exit ports positioned distally from the spindle, the distribution rotor channels configured to fluidly communicate with the spindle passageway; and an outer rotor coupled to the spindle and positioned to receive fluid expelled orthogonally from the distribution rotor channels through centrifugal force during rotation of the spindle, distribution rotor and outer rotor, wherein the centrifugal force holds at least a portion of the particulates in the fluid to the outer rotor while the fluid may flow down an interior surface of the outer rotor, and the portion of the particulates held to the outer rotor includes particulates having a size less than 2 microns.

11. The centrifuge according to claim 10, wherein rotation of the outer rotor produces a centrifugal force onto the fluid of at least 10,000 g's.

12. The centrifuge according to claim 10, further comprising holes in a bottom portion of the outer rotor configured to remove fluid from the centrifuge, wherein the fluid removed from the centrifuge has an equilibrium concentration for the particulates at about 1% or less.

13. The centrifuge according to claim 11, wherein: the distribution rotor has a conical inner structure; and the conical inner structure has a larger diameter near distribution channels in the distribution rotor and a smaller diameter away from the distribution channels.

* * * * *